US010850880B2

(12) United States Patent
Ross

(10) Patent No.: US 10,850,880 B2
(45) Date of Patent: Dec. 1, 2020

(54) PLASTIC BAG DISPENSER

(71) Applicant: HIGHWAVE, Oxnard, CA (US)

(72) Inventor: Gary Ross, Oxnard, CA (US)

(73) Assignee: HIGHWAVE, Oxnard, CA (US)

( * ) Notice: Subject to any disclaimer, the term of this patent is extended or adjusted under 35 U.S.C. 154(b) by 89 days.

(21) Appl. No.: 16/501,321

(22) Filed: Mar. 27, 2019

(65) Prior Publication Data

US 2020/0307842 A1 Oct. 1, 2020

(51) Int. Cl.
*B65B 43/12* (2006.01)

(52) U.S. Cl.
CPC ..... *B65B 43/123* (2013.01)

(58) Field of Classification Search
CPC .. B65H 35/002; B65H 37/005; B65H 49/205; B65H 75/406; B65H 2402/41; B65B 43/123; B65B 67/085
USPC ..... 242/596, 596.7, 596.8, 588, 588.1
See application file for complete search history.

(56) References Cited

U.S. PATENT DOCUMENTS 431,347 A * 7/1890 Gore ..... B65H 49/32 242/129.6
1,508,263 A * 9/1924 Younger ..... H06F 53/045 242/398
1,548,302 A * 8/1925 Brown ..... B65H 75/406 242/396.2
4,390,096 A * 6/1983 Goldenberg ..... A41D 3/08 2/84
4,582,273 A * 4/1986 Saraisky ..... B65H 75/08 242/588.1
4,799,721 A * 1/1989 Hale ..... B65G 7/12 16/444
4,998,685 A * 3/1991 Spencer ..... B65H 75/14 242/137
5,172,966 A * 12/1992 Myatt ..... A47K 10/38 225/43
6,824,031 B2 * 11/2004 McKenzie ..... A45F 3/14 224/666
7,392,921 B1 * 7/2008 McKenzie ..... A45F 3/14 224/666
7,395,950 B2 * 7/2008 Ropp ..... B65H 49/205 223/106
2001/0042296 A1 * 11/2001 Yonenoi ..... B65H 59/225 29/450
2007/0057110 A1 * 3/2007 Ropp ..... D05B 91/12 242/588.1

(Continued)

*Primary Examiner* — William A. Rivera
(74) *Attorney, Agent, or Firm* — Jonathan E. Grant; Grant Patent Services

(57) ABSTRACT

A plastic bag dispenser is disclosed. The plastic bag dispenser contains an elastic cord which has a first a first end and a second end. There is also a first spindle, which has the ability to connect to the first end of said elastic cord, and a second spindle, which has the ability to connect to the second end of the elastic cord, such that when the first spindle is connected to the first end of said elastic end and the second spindle is connected to the second end of the elastic cord, there exists the ability to hold a roll of plastic bags between the first spindle and the second spindle without the roll of plastic bags unraveling. The adjustable elastic cord secures the plastic bags to the roll on which the plastic bags are wrapped and serve to act as a pressure element to easily tear off a perforated bag.

7 Claims, 5 Drawing Sheets

(56) References Cited

U.S. PATENT DOCUMENTS

| | | | | |
|---|---|---|---|---|
| 2011/0240669 | A1* | 10/2011 | Festa | B60R 15/02 221/45 |
| 2015/0014472 | A1* | 1/2015 | Hussain | B65H 75/185 242/598 |
| 2020/0024101 | A1* | 1/2020 | Brereton | B65H 16/00 |

* cited by examiner

PLASTIC BAG DISPENSER

A plastic bag dispenser is disclosed that helps retain the bags so that no more bags are dispensed than are pulled out.

BRIEF DESCRIPTION OF THE FIGURES

The figures depict various embodiments of the described methods and system and are for purposes of illustration only. One skilled in the art will readily recognize from the following discussion that alternative embodiments of the methods and systems illustrated herein may be employed without departing from the principles of the methods and systems described herein.

DETAILED DESCRIPTION OF THE DISCLOSURE

Figure 1:
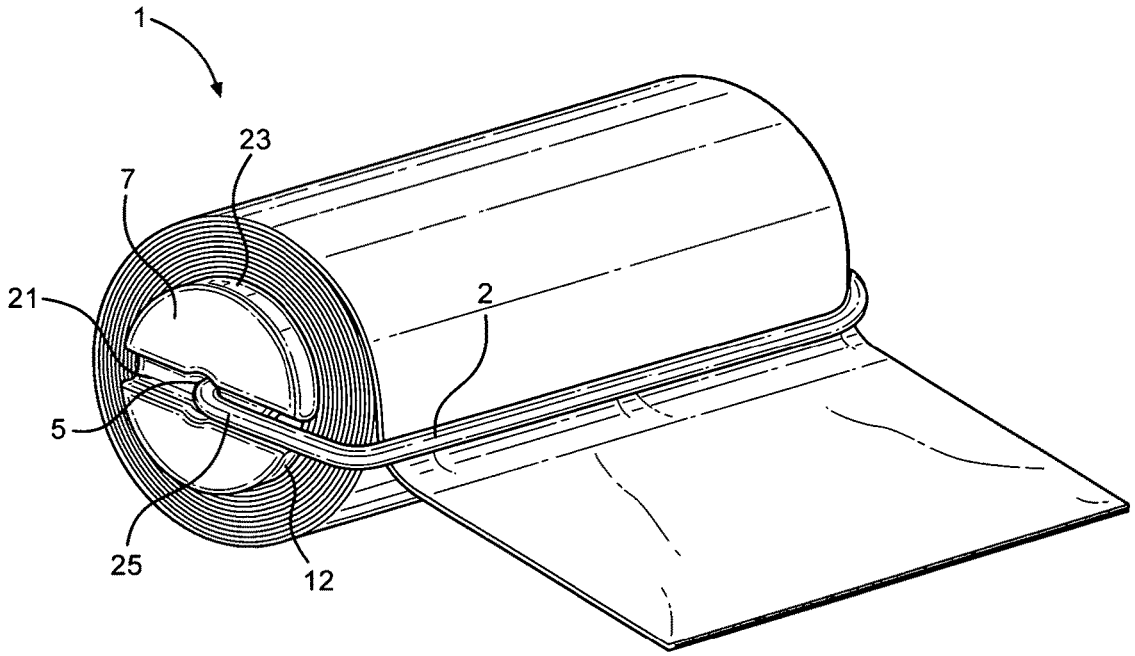
FIG. 1 is a perspective view of the plastic bag dispenser with the roll of plastic bags attached.
Figure 2:
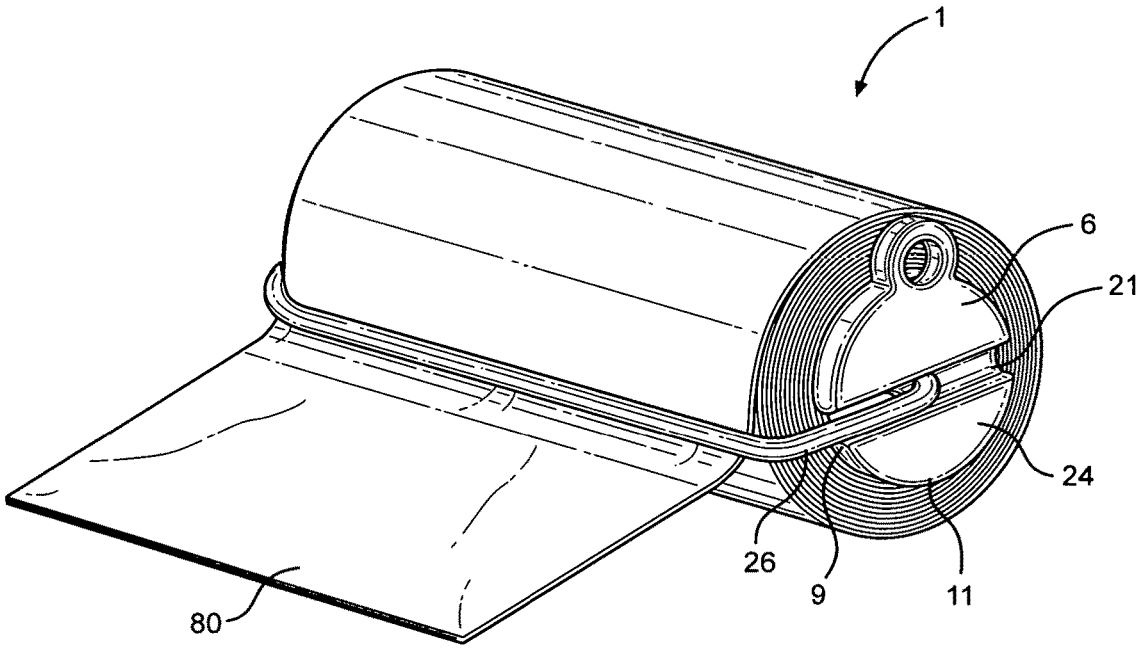
FIG. 2 is a second perspective view of the plastic bag dispenser showing the other end of the dispenser.
Figure 3:
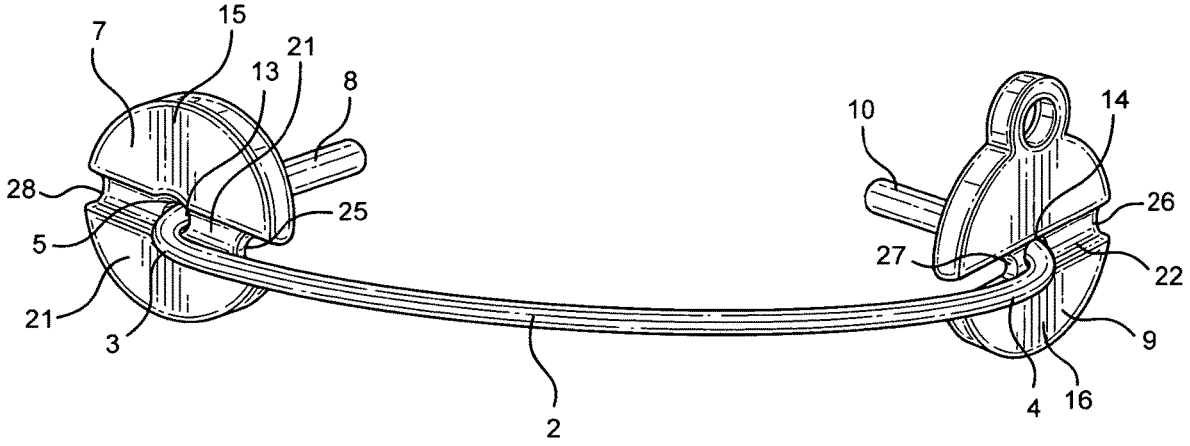
FIG. 3 is an inside perspective view of the parts of the plastic hag dispenser.
Figure 4:
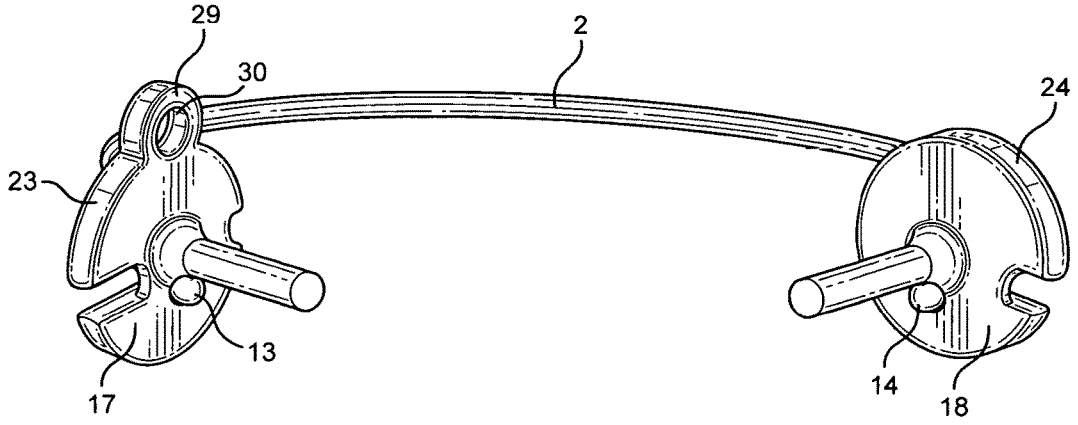
FIG. 4 is an outside perspective view of the parts of the plastic bag dispenser.
Figure 5:
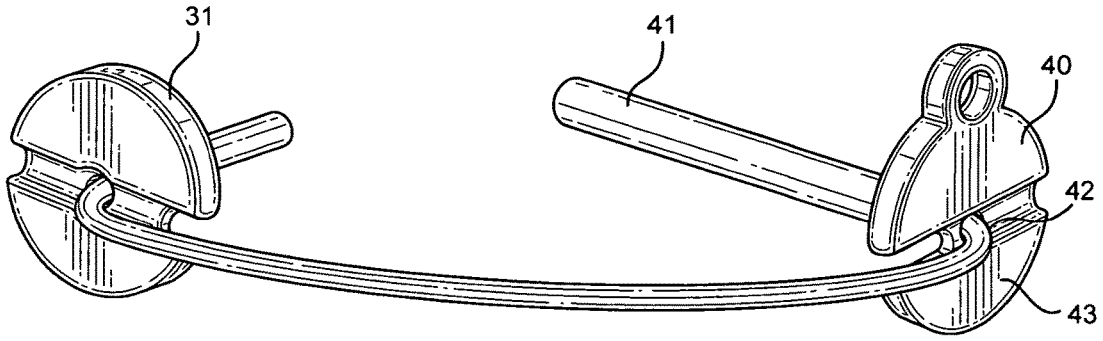
FIG. 5 is another embodiment of the plastic bag dispenser.
Figure 6:
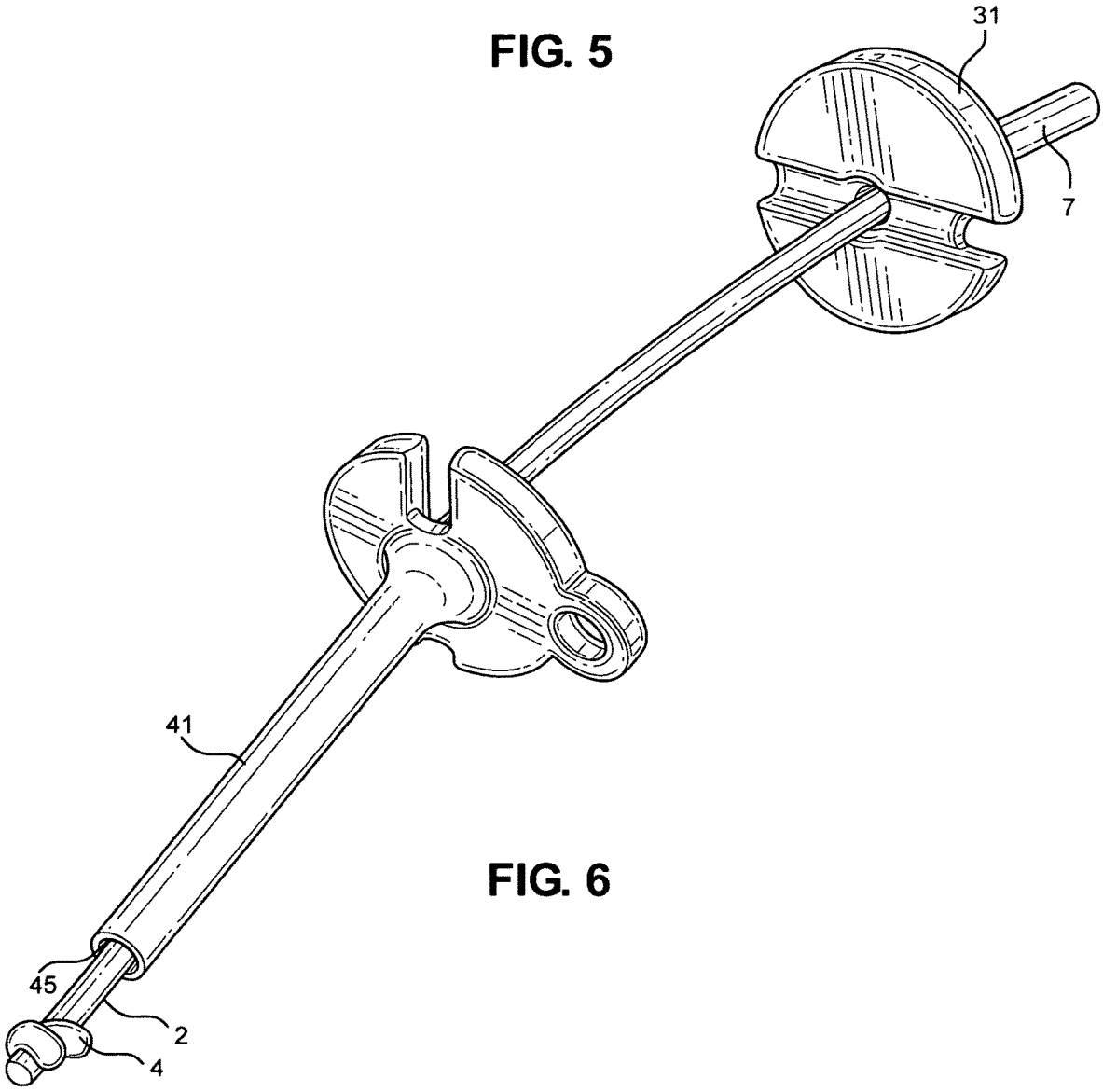
FIG. 6 is an overhead perspective view of the elongated spindle of FIG. 5.
Figure 7:
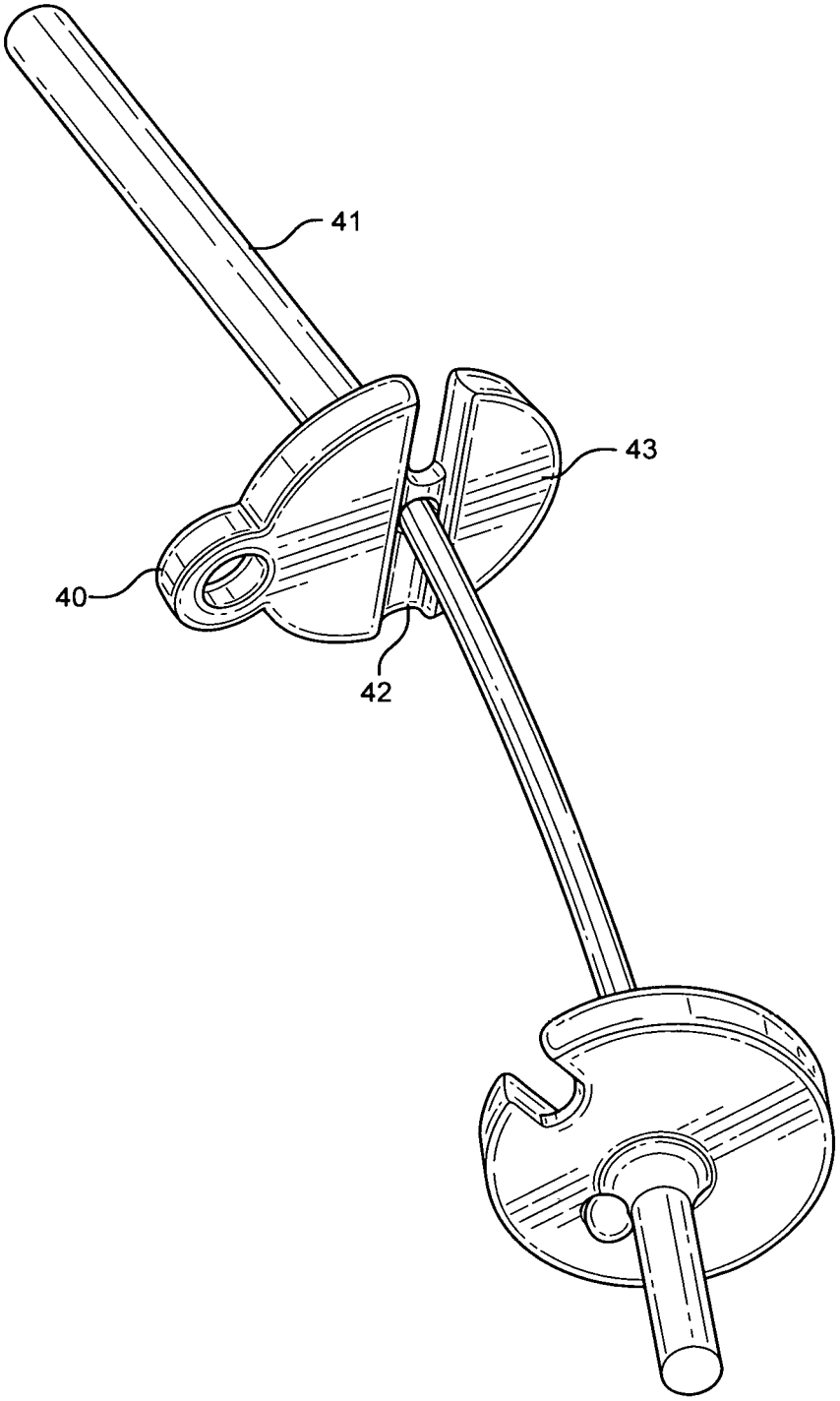
FIG. 7 is a distal end of the elongated spindle of FIG. 6.
Figure 8:
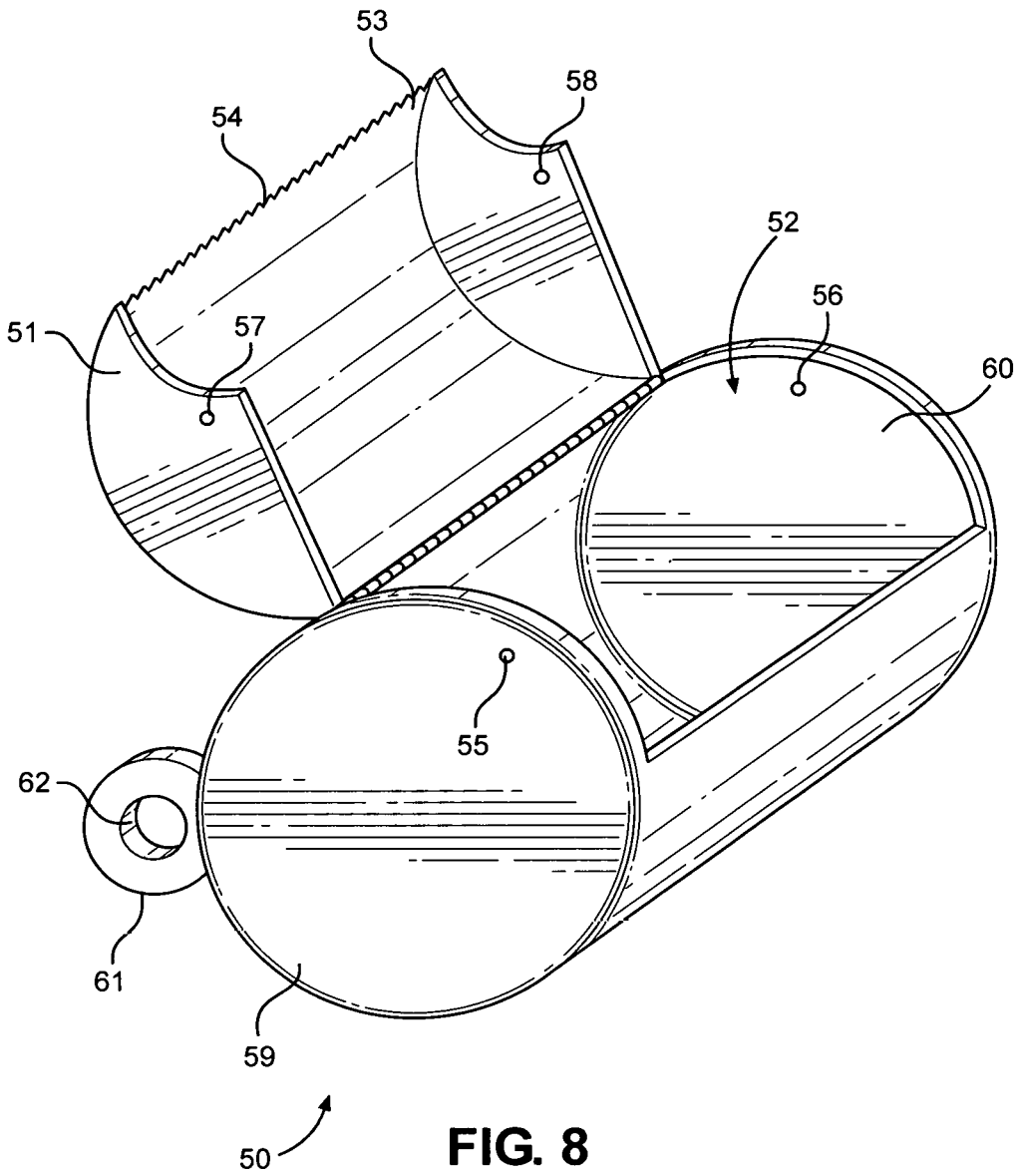
FIG. 8 is a metal container for the plastic bag dispenser.

The purpose of the plastic bag dispenser 1 is to allow for the retention and dispersal of plastic bags 80, designed to be particularly useful when dog walking. The ease of dispersal of a limited number of bags at one time allows for the easy removal of animal waste, without the worry of stuffing plastic bags 80 in a pocket where they can easily fall out.

The plastic bag dispenser 1 has an elastic band or cord 2. The elastic cord 2 has a first end 3 and a second end 4. The plastic bag dispenser 1 also has two spindles 5 and 6. The first spindle 5 has a base 7, and a pole 8. The pole 8 intersects with the base 7. In one embodiment, the pole 8 is integral with the base 7 and in another embodiment, the pole positioned to the central part of the base. In one embodiment, spindle 6 identical to spindle 5, having both a base 9 and a pole 10. In one embodiment, both spindles 5, 6, are the identical length and neither are more than one half the length of the plastic bag 80 into which the spindles 5,6, fit. More specifically, the poles 8, 10 fit within the side openings 11, 12 of the roll of plastic bags 80.

Each of the spindles 5,6, has a hole 13, 14 drilled from the outside 15, 16 of the base 7, 9 to the inside of the base 17,18. In one embodiment, holes 13, 14 is angularly drilled into the center of the outside 15, 16 of the base 7,9 to the inside 17,18 of the base 7,9. The first end 3 of the elastic cord 2 is fitted through the first hole 13 in the first base 7 and, after it exits the first hole 13, the first end 3 of the elastic cord 2 is knotted so it does not slide back out. The second end 4 of the elastic cord 2 is similarly fitted through the second hole 14 positioned through the second base 9 and subsequently knotted. When the spindles are positioned in the side openings 11, 12 at either end of the roll of plastic bags 80, the elastic cord 2, holds the plastic bags 80 in place on the roll, placing pressure on the roll, while allowing the user to pull out and tear it off a perforated bag. That way, bags do not go flying all over the place when just one bag is needed, particularly when picking up dog waste. The elastic cord 2 can be a woven elastic cord, cloth covered cord or any other form of cord.

In another embodiment, grooves 21, 22 bisect the outside of the bases 7,9. This allows the elastic cord 2 to fit within the grooves 21, 22, and avoid rubbing against the edges 23, 24 of the bases 7,9. In yet another embodiment, one side 25,26 of the groove is deeper than the other side 27, 28.

In another embodiment, there is a tab 29 attached to one of the bases 7,9 with a hole 30 in the middle of the tab 29 so that a chain or a string could attach the plastic bag dispenser to a purse or pants loop.

In yet another embodiment of the disclosure, there is a first spindle 31 just like spindles 5, 6 above; however, a second pole 41 of the second spindle 40 extends along the length (or height) of the roll of plastic bags 80. In one embodiment, the second pole 41 extends beyond the length (or height) of the roll of plastic bags 80. In another embodiment, the second pole is slightly shorter than the length (or height) of the roll of plastic bags 80 The second pole 41 is hollow 45 with a wide enough diameter for the first pole 7 to slide into second pole 41. The first pole 7 fits partially or in its entirety into second pole 41. Quantitatively, the second pole 41, should cover at least about 50% of the first pole 7, or in another embodiment at least about 75% of the first pole 7 and in another embodiment at least 90% of the first pole 7 is enclosed by the second pole 41. In another embodiment, the second pole 41 extends up to 125% of the length of the opening in the roll of plastic bags 80. In another embodiment, the second pole 41 extends up to about 100% of the length of the opening in the roll of plastic bags, and in another embodiment, the second pole 41 extends up to about 75% of the length of the opening in the roll of plastic bags.

In one embodiment of the second spindle 40 the hole 42 that bisects the base 43 is centered and goes into the hollow spindle, to where it can be knotted.

In another embodiment, a metal or plastic enclosure 50 fits around the roll of plastic bags on the spindles. A hinged door 51 opens and allows the plastic bag dispenser to be inserted or a new roll of bags added into the main body 52. The edge 53 of the door has a cutting ridge 54, against which the plastic bag can be pulled when in it is time to separate one bag from another. The door is closed and held in place by indent snaps 55, 56 in the side of the body of the enclosure, which align with the indents 57, 58 on two downwardly projecting sides 59, 60 of the hinged door 50. In one embodiment, there is a loop 61, with a hole 62 for attachment to a string or clip.

The embodiments disclosed in this application are to be considered in all respects as illustrative and not limiting. The scope of the disclosure is indicated by the appended claims rather than by the foregoing description, and all changes which come within the meaning and range of equivalency of the claims are intended to be embraced therein.

I claim:

1. A plastic bag dispenser, said plastic bag dispenser comprising:

a) An elastic cord, said elastic cord having a first end and a second end;

b) a first spindle, said first spindle having the ability to connect to said first end of said elastic cord, said first spindle comprising:

1) A first elongated pole, said first elongated pole fitting through a first opening positioned on one end of said roll of plastic bags;

2) a first base to which said first elongated pole is attached and centered, said first base being larger than the central opening of said roll of plastic bags, said first base of said first spindle comprising a first through hole through which said first end of said elastic cord is passed through and knotted; and 3) a first groove extending across a surface of said base;

c) a second spindle, said second spindle having the ability to connect to said second end of said elastic cord, said second spindle comprising:

1) A second elongated pole, said second elongated pole fitting through a second opening positioned opposite the first opening on another end of said roll of plastic bags; and 2) a second base to which said second elongated pole is attached and centered, said first base and said second base being larger than the central opening of said roll of plastic bags, said second base of said second spindle comprising a second pass through hole through which said second end of said elastic cord is passed through and knotted;

3) a second groove extending across a surface of said second base;

such that when said when said first spindle is connected to said first end of said elastic end and said second spindle is connected to said second end of said elastic cord, there exists the ability to hold a roll of plastic bags between said first spindle and said second spindle, said elastic cord securing a plurality of bags to said roll of plastic bags, said first spindle and said second spindle fitting within opposing openings of the roll of plastic bags.

2. The plastic bag dispenser of claim 1, wherein:

a) said first groove of said first spindle further comprises:

i) a first half of the first groove;

ii) a second half of the first groove, said second half of said first groove being deeper than said first half of the first groove; and b) said second groove of said second spindle further comprises:

i) a first half of the second groove;

ii) a second half of the second groove, said second half of said second groove being deeper than said first half of the second groove.

3. The plastic bag dispenser of claim 1, wherein a) said first elongated pole extends along a length of the roll of plastic bags;

b) said second elongated pole is hollow and is able to fit within it the first elongated pole.

4. The bag dispenser of claim 3, wherein:

a) said first base of said first spindle further comprises a first hole through which said first end of said elastic cord is attached; and b) said second base of said second spindle comprising a second hole through which said second end of said elastic cord is attached.

5. The bag dispenser of claim 4, further wherein said second hole of said second base communicates with a hollow section of said second spindle, allowing for the ability of said elastic cord to be threaded through said second base and through said hollow section of said second spindle whereupon said elastic cord has the ability to be knotted.

6. The bag dispenser of claim 1, further comprising a loop to which is attached to either said first base or said second base.

7. The bag dispenser of claim 1, further comprising an outer shell surrounding said roll of plastic bags, said dispenser comprising:

a) a lip;

b) a cutter on or near the edge of said lip;

c) a door to allow said bag dispenser to be inserted in said outer shell.

* * * * *